US008721347B2

(12) United States Patent
Xiao et al.

(10) Patent No.: US 8,721,347 B2
(45) Date of Patent: May 13, 2014

(54) RF RECEPTACLE CONNECTOR HAVING CENTRAL CONDUCTOR FIRMLY RETAINED WITH INSULATIVE HOUSING

(75) Inventors: Jian-Ping Xiao, Shenzhen (CN); Ming-Lun Kuo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 6 days.

(21) Appl. No.: 13/429,682

(22) Filed: Mar. 26, 2012

(65) Prior Publication Data

US 2012/0244749 A1 Sep. 27, 2012

(30) Foreign Application Priority Data

Mar. 25, 2011 (CN) ..... 2011 2 0083757

(51) Int. Cl.
*H01R 12/00* (2006.01)

(52) U.S. Cl.
USPC ..... 439/63

(58) Field of Classification Search
USPC ..... 439/63, 581, 578; 29/876
See application file for complete search history.

(56) References Cited

U.S. PATENT DOCUMENTS

| | | | | |
|---|---|---|---|---|
| 5,078,621 | A * | 1/1992 | Nishikawa et al. | 439/581 |
| 5,322,453 | A * | 6/1994 | Resnick et al. | 439/581 |
| 6,074,217 | A * | 6/2000 | Maruyama et al. | 439/63 |
| 6,474,995 | B1 * | 11/2002 | Wu | 439/63 |
| 6,902,408 | B2 * | 6/2005 | Yamane | 439/63 |
| 7,118,383 | B2 * | 10/2006 | Nagata et al. | 439/63 |
| 7,334,327 | B1 * | 2/2008 | Chen et al. | 29/876 |
| 7,651,334 | B2 * | 1/2010 | Zhang | 439/63 |
| 7,976,315 | B2 * | 7/2011 | Zuinen et al. | 439/63 |
| 7,993,144 | B2 * | 8/2011 | Hu et al. | 439/63 |
| 8,298,007 | B2 * | 10/2012 | Taguchi | 439/578 |
| 8,414,306 | B2 * | 4/2013 | Tagawa et al. | 439/63 |

* cited by examiner

*Primary Examiner* — Alexander Gilman
(74) *Attorney, Agent, or Firm* — Ming Chieh Chang; Wei Te Chung

(57) ABSTRACT

An RF connector (100) for receiving a mating connector along a mating direction, includes an insulative housing (1), an outer conductor (3) retained with the insulative housing, and a central conductor (2) retained with the insulative housing. The outer conductor includes a tubular section (31) defining an axial line along the mating direction and a number of leg sections (32, 33) extending outwardly from a bottom of the tubular section. The central conductor includes a contact section (22) positioned within the tubular section along the mating direction, a radial section (21) extending outwardly from a bottom of the contact section along a radial direction perpendicular to the mating direction, and an extension section (24) extending out of the insulative housing. The extension section is connected with the radial section via a declined connection portion (23). The insulative housing extends below the radial section.

18 Claims, 4 Drawing Sheets

RF RECEPTACLE CONNECTOR HAVING CENTRAL CONDUCTOR FIRMLY RETAINED WITH INSULATIVE HOUSING

CROSS-REFERENCE TO RELATED APPLICATIONS

Background of the Invention

1. Field of the Invention

The present invention relates generally to an RF (Radio Frequency) connector, and more particularly to an RF receptacle connector having a central conductor firmly retained with an insulative housing.

2. Description of Related Arts

An RF receptacle usually receives an RF plug for signal transmission. The RF receptacle comprises an insulative housing, a central conductor retained with the insulative housing, and an outer conductor shrouding around the central conductor and retained with the insulative housing, too. The outer conductor comprises a tubular portion and a plurality of soldering pads at lower ends of the tubular portion. The central conductor comprises a soldering portion and a contacting portion extending laterally and upwardly from the soldering portion. The contacting portion of the central conductor extends in an axial direction within the tubular portion.

U.S. Pat. No. 7,651,334 discloses an RF receptacle connector whose central connector having a radial section and an extension section connecting to the radial section via a connection point. An insulative housing is formed merely above the radial section so that the central connector is not firmly retained in the insulative housing and may shake away when a mating connector is inserted.

U.S. Pat. No. 6,902,408 discloses another RF receptacle connector whose radial section comprising a raised portion and therefore, an indented portion is defined below the raised portion. Retaining force increased between these indented and raised portions and the insulative housing. Because the raised portion is forged after a pressing process, two working procedures are needed which is rather troublesome. Furthermore, the connection points between the raised portion and the radial section are weak and may be cracked if the forging procedure is not well-controlled.

Hence, an RF receptacle connector having a central conductor firmly retained with an insulative housing, simply manufactured and preventing being cracked is desired.

SUMMARY OF THE INVENTION

Accordingly, an object of the present invention is to provide an RF receptacle connector preventing from being damaged by a mating connector.

To achieve the above object, an RF connector for receiving a mating connector along a mating direction, includes an insulative housing, an outer conductor retained with the insulative housing, and a central conductor retained with the insulative housing. The outer conductor includes a tubular section defining an axial line along the mating direction and a number of leg sections extending outwardly from a bottom of the tubular section. The central conductor includes a contact section positioned within the tubular section along the mating direction, a radial section extending outwardly from a bottom of the contact section along a radial direction perpendicular to the mating direction, and an extension section extending out of the insulative housing. The extension section is connected with the radial section via a declined connection portion. The insulative housing extends below the radial section.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-4, an RF receptacle connector 100 assembled on a printed circuit board (not shown), comprises an insulative housing 1, a central conductor 2 retained with the insulative housing 1, and an outer conductor 3 shrouding around the central conductor 2 and retained with the insulative housing 1, too.

Figure 1:
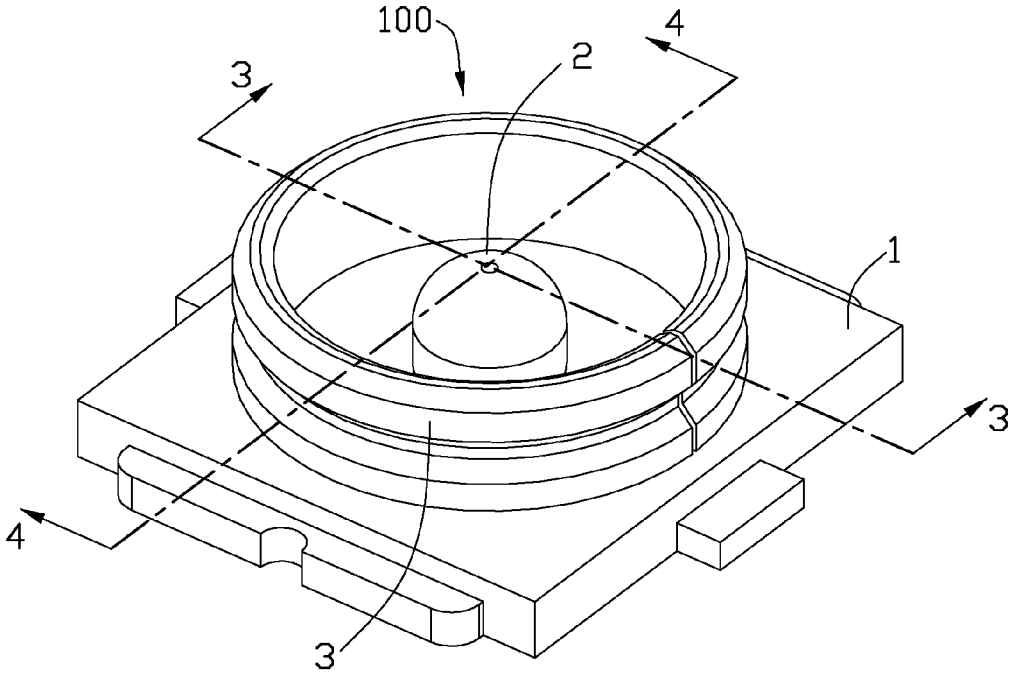
FIG. 1 is a perspective, assembled view of an RF connector constructed in accordance with the present invention.
Figure 2:
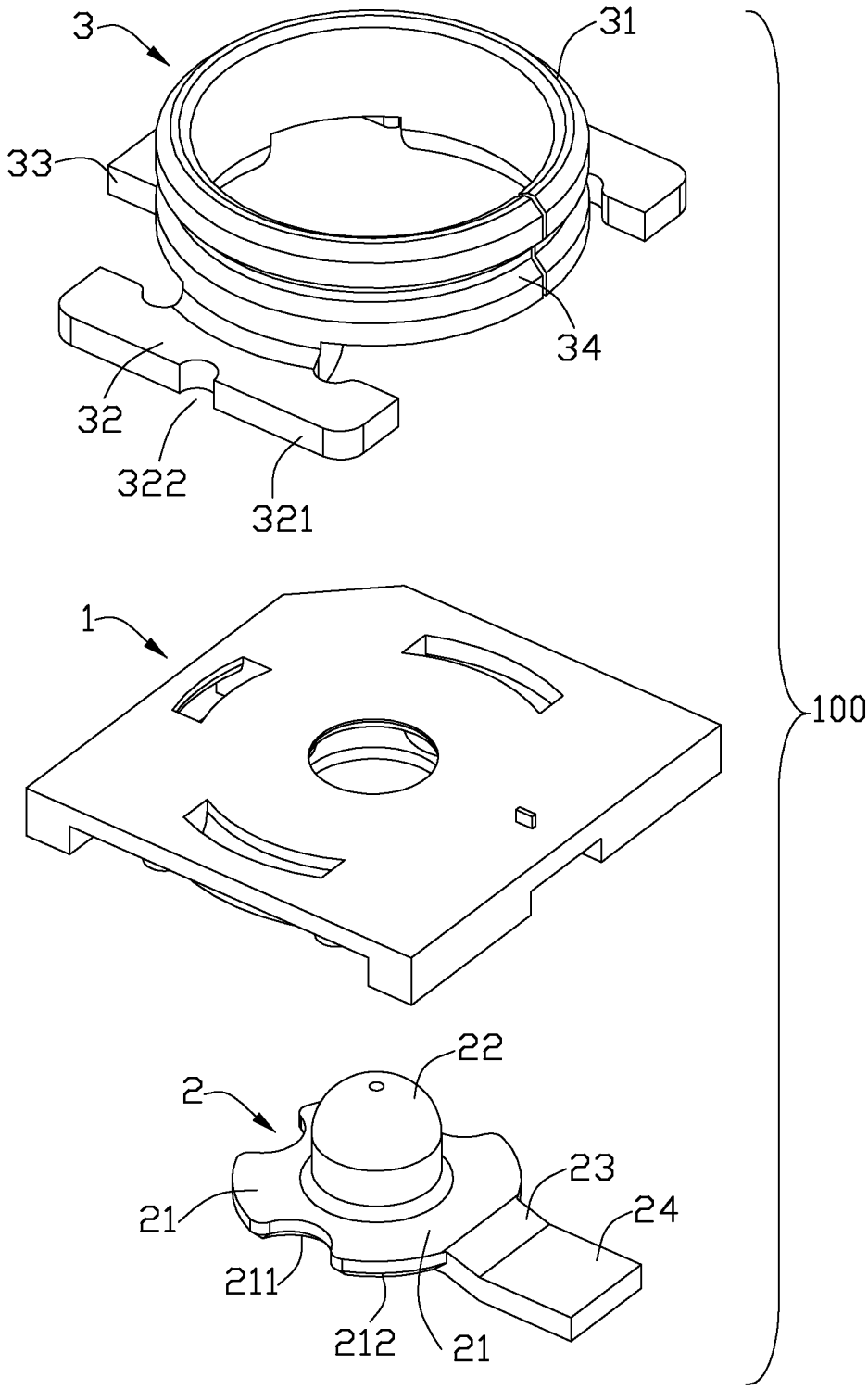
FIG. 2 is a perspective, exploded view of the RF connector.
Figure 3:
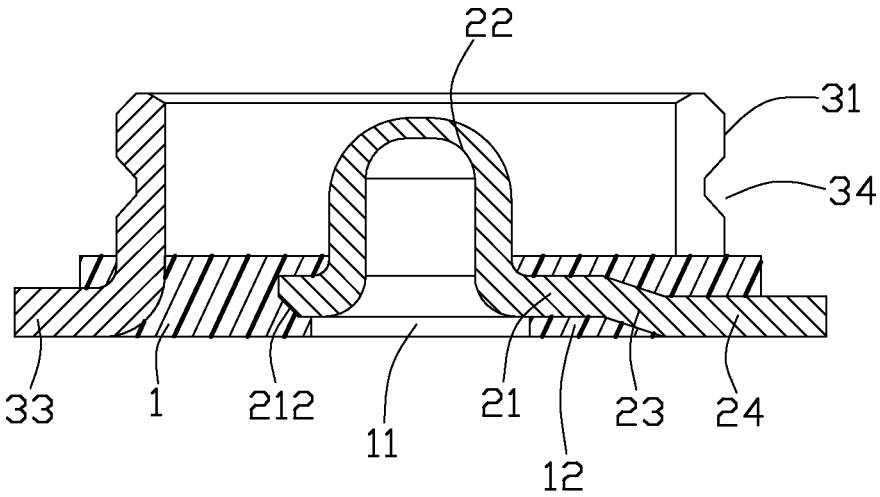
FIG. 3 is a first cross-sectional view of the RF connector taken along line 3-3 of FIG. 1.
Figure 4:
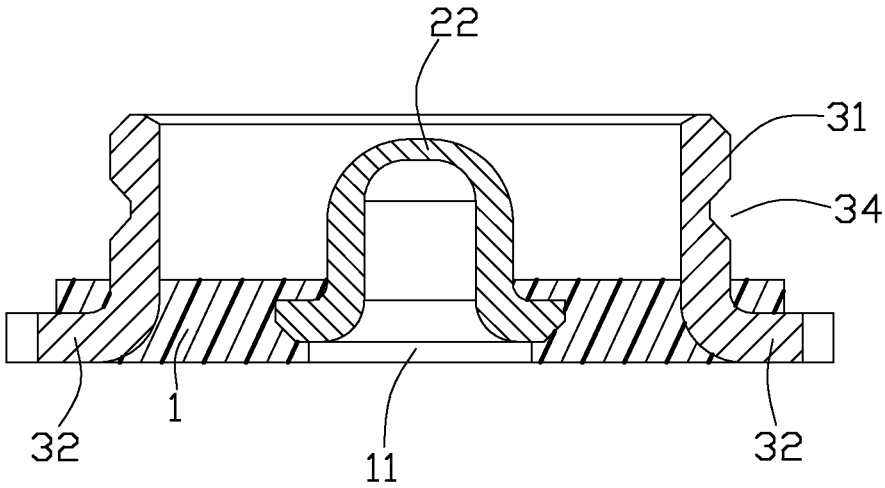
FIG. 4 is a second cross-sectional view of the RF connector taken along line 4-4 of FIG. 1.

Referring to FIGS. 2-4, the outer conductor 3 comprises a tubular section 31 defining an axial line along a mating direction for receiving a mating connector (not shown) and three leg sections 32, 33 extending outwardly from a bottom of the tubular section 31. The tubular section 31 is provided with an engaging groove 34 for engagement with an outer conductor of the mating connector for preventing separation. The leg sections 32, 33 comprises a pair of first leg sections 32 opposed to each other along a diametrical direction and a second leg section 33 positioned along a transverse direction with respect to the first leg sections 32. The first and second leg sections 32, 33 are flush with a bottom face of the insulative housing 1 so that when the RF connector 100 is placed on the printed circuit board, the first and second leg sections 32, 33 are soldered with circuit traces (not shown) of the printed circuit board. Each first leg section 32 has two solder wings 321 and defines a groove 322 between the two solder wings 321. Therefore, it enables the additional solder material to be gathered within the groove 322 so as to prevent the overflow of material during the soldering process.

Referring to FIGS. 2-4, the central conductor 2 comprises a contact section 22 extending along an axial direction within the tubular section 31 and a radial section 21 extending outwardly from a bottom of the contact section 22 along a radial direction. The axial direction is consistent with the mating direction. The contact section 22 is made by deep-drawing pressing a metal sheet so as to provide a hollow form having a semi-spherical tip and flared bottom that leads to the radial section 21. An extension section 24 extends in a plane lower than the radial section 21 and is connected with the radial section 21 via a declined connection portion 23. The extension section 24 is flush with a bottom face of the insulative housing 1 for being soldered with the printed circuit board. It should be noted that the tip of the contact section 22 of this present invention, as particularly shown in FIGS. 3 and 4, is lower than the top of the tubular section 31. Therefore, the mating connector is firstly guided by the tubular section 31 of the outer conductor 3 and then connects with the contact section 22 of the central conductor 2, preventing the contact section 22 of the central conductor 2 from enduring a large insertion force from the mating connector. The contact section 22 is prevented from being damaged if the mating connector is falsely inserted. The RF connector 100 has a long life cycle accordingly.

Referring to FIGS. 1-4, before molding, the tubular section 31 of the outer conductor 3 is shrouded around the contact section 22 of the central conductor 2 when the extension portion 24 is positioned along the transverse direction oppose to the second leg section 33. A supporting pin (not shown) is provided under the contact section 22 for stabilizing the central conductor 2. Thereafter, the insulative housing 1 is insert-molded with the central conductor 2 and the outer conductor 3. After molding, the tubular section 31 of the outer conductor 3 and the contact section 22 of the central conductor 2 extend beyond a top face of the insulative housing 1 for engaging with the mating connector. The first and second leg sections 32, 33 are partly retained in the insulative housing 1 for retaining the outer conductor 3 with the insulative housing 1 and partly extend out of the insulative housing 1 for being soldered on the printed circuit board. The extension portion 24 extends out of the insulative housing 1 for being soldered on the printed circuit board. In the preferred embodiment of the present invention, the insulative housing 1 is molded partly above the radial section 21 as well as the connection portion 23 and partly below the radial section 21 as well as the connection portion 23 for increasingly retaining the central conductor 2 in the insulative housing 1. A bevel 212 is defined below curved edges of the radial section 21 for facilitating fabrication. The bevel 212 is retained in the insulative housing 1. Finally, the supporting pin is drawn and a dish-like cutout or round recess 11 is defined on a bottom face of the insulative housing 1 corresponding to the contact section 22 of the central conductor 2.

Generally speaking, the insulative housing 1 extends below the radial section 21, i.e., the insulative housing 1 comprises a lower part 12 beside the extension section 24 and directly approaching the cutout 11. Therefore, the central conductor 2 is firmly retained with the insulative housing 1 and stably engaged with the mating connector. Because the extension section 24 is bended from the radial section 21, the connection section 23 is not easily cracked. The central conductor 2 is formed during one pressing process for simplifying the manufacturing procedure.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An RF (Radio Frequency) connector for receiving a mating connector along a mating direction, comprising:

an insulative housing;

an outer conductor retained with the insulative housing, the outer conductor comprising a tubular section defining an axial line along the mating direction and a plurality of leg sections extending outwardly from a bottom of the tubular section; and a central conductor retained with the insulative housing, the central conductor comprising a contact section positioned within the tubular section along the mating direction, a radial section extending outwardly from a bottom of the contact section along a radial direction perpendicular to the mating direction, and an extension section extending out of the insulative housing, the extension section being connected with the radial section via a declined connection portion; wherein the insulative housing extends below the radial section; and wherein a cutout is defined on a bottom face of the insulative housing corresponding to the contact section of the central conductor and the insulative housing comprises a lower part beside the extension section and directly approaching the cutout.

2. The RF connector as claimed in claim 1, wherein a bevel is defined below curved edges of the radial section and the bevel is retained in the insulative housing.

3. The RF connector as claimed in claim 1, wherein the leg sections comprises a pair of first leg sections opposed to each other along a diametrical direction and a second leg section positioned along a transverse direction with respect to the first leg sections.

4. The RF connector as claimed in claim 3, wherein the extension portion is positioned along the transverse direction oppose to the second leg section.

5. The RF connector as claimed in claim 4, wherein each first leg section has two solder wings and defines a groove between the two solder wings.

6. The RF connector as claimed in claim 1, wherein the leg sections and the extension section are flush with a bottom face of the insulative housing.

7. The RF connector as claimed in claim 1, wherein tip of the contact section is lower than top of the tubular section.

8. An RF (Radio Frequency) connector comprising:

an insulative housing defining opposite upper and under surfaces with an outer conductor and an inner conductor integrally formed therewith via an insert molding process;

said outer conductor defining an upstanding large round tubular section with a lower portion embedded in the housing and an upper portion exposed above the upper surface of the housing to define a receiving cavity for receiving a mating connector, said inner conductor defining an upstanding small round tubular section sealed on a top end and located at a center of said large round tubular section, a flared radial section unitarily extending radially and outwardly from a bottom end of the small round tubular section at a first level between the upper and under surfaces, and a horizontal extension section located at a second level lower than the first level and essentially closer to the under surface, and extending radially outwardly relative to the radial section with a connection section linked between the extension section and the radial section and extending in both a radial direction and a vertical direction which are perpendicular to each other; wherein at least a peripheral region of the extension section is essentially embedded and sandwiched in the housing along the vertical direction so as to assure retention of the inner conductor in the housing in the vertical direction while the housing leaves a circular recess under the small round tubular section thus allowing an interior space of the small round tubular section to communicate with an exterior downwardly; wherein a diameter of the recess is dimensioned between an inner diameter of the small round tubular section and an outer diameter of the radial section.

9. The RF connector as claimed in claim 8, wherein the horizontal extension section is located on the under surface around a peripheral region of the housing.

10. The RF connector as claimed in claim 9, wherein the outer conductor includes a plurality of horizontal solder tails at the second level and on the under surface around said peripheral region of the housing and spaced from the horizontal extension section.

11. The RF connector as claimed in claim 10, wherein the radial section defines a plurality of notches evenly along a periphery of enhancement of retention to the housing, and said notches extend vertically through the radial section and filled with the housing.

12. The RF connector as claimed in claim 8, wherein said connection section extends obliquely in a side view.

13. The RF connector as claimed in claim 8, wherein an outer diameter of small round tubular section is smaller than the diameter of the recess.

14. The RF connector as claimed in claim 8, wherein a portion of the housing above the radial section circumferentially contacts an exterior face of a bottom portion of the small round tubular section.

15. The RF connector as claimed in claim 8, wherein the radial section, the extension section and the connection section essentially share a same thickness while the small round tubular section is not.

16. The RF connector as claimed in claim 8, wherein a portion of the housing above the radial section circumferentially contacts an exterior face of a bottom portion of the small round tubular section.

17. An RF (Radio Frequency) connector comprising:

an insulative housing defining opposite upper and under surfaces with an outer conductor and an inner conductor integrally formed therewith via an insert molding process;

said outer conductor defining an upstanding large round tubular section with a lower portion embedded in the housing and an upper portion exposed above the upper surface of the housing to define a receiving cavity for receiving a mating connector, said inner conductor defining an upstanding small round tubular section sealed on a top end and located at a center of said large round tubular section, a flared radial section unitarily extending radially and outwardly from a bottom end of the small round tubular section at a first level between the upper and under surfaces, and a horizontal extension section located at a second level lower than the first level and essentially closer to the under surface, and extending radially outwardly relative to the radial section with a connection section linked between the extension section and the radial section and extending in both a radial direction and a vertical direction which are perpendicular to each other; wherein at least a peripheral region of the extension section is essentially embedded and sandwiched in the housing along the vertical direction so as to assure retention of the inner conductor in the housing in the vertical direction while the housing leaves a circular recess under the small round tubular section thus allowing an interior space of the small round tubular section to communicate with an exterior downwardly; wherein the radial section defines a plurality of notches evenly along a periphery of enhancement of retention to the housing, and said notches extend vertically through the radial section and filled with the housing.

18. The RF connector as claimed in claim 17, wherein a diameter of the recess is dimensioned smaller than an outer diameter of the radial section.

* * * * *